US007668333B2

(12) United States Patent
Horigome et al.

(10) Patent No.: US 7,668,333 B2
(45) Date of Patent: Feb. 23, 2010

(54) SPEAKER FRAME AND SPEAKER DEVICE HAVING A SPEAKER FRAME

(75) Inventors: Minoru Horigome, Yamagata (JP); Toshihiro Hikichi, Yamagata (JP); Takashi Haba, Yamagata (JP)

(73) Assignee: Pioneer Corporation, Tokyo (JP)

( * ) Notice: Subject to any disclaimer, the term of this patent is extended or adjusted under 35 U.S.C. 154(b) by 815 days.

(21) Appl. No.: 11/293,170

(22) Filed: Dec. 5, 2005

(65) Prior Publication Data

US 2006/0147066 A1 Jul. 6, 2006

(30) Foreign Application Priority Data

Dec. 6, 2004 (JP) ..... P2004-353313

(51) Int. Cl.
*H04R 9/02* (2006.01)

(52) U.S. Cl. ..... 381/433; 381/397

(58) Field of Classification Search ..... 381/396, 381/397, 412, 433

See application file for complete search history.

(56) References Cited

U.S. PATENT DOCUMENTS 6,243,479 B1 * 6/2001 Proni ..... 381/397

FOREIGN PATENT DOCUMENTS

JP A-2000-244997 9/2000

* cited by examiner

*Primary Examiner*—Brian Ensey
(74) *Attorney, Agent, or Firm*—Drinker Biddle & Reath LLP

(57) ABSTRACT

A speaker frame comprising: a rear end wall; a damper support portion; an edge support portion to which an edge as an outer circumferential portion of a vibration plate is to be stuck and fixed; and plural frame arms which connect the edge support portion to the rear end wall and the damper support portion, wherein: a width of each of the frame arms increases as the position goes from the edge support portion to the damper support portion, and damper-support-portion-side end portions of side edges of adjoining frame arms are continuous with each other to form a single as an axis of symmetry, a bisector of an angle formed by the adjoining frame arms; and a single vent window is formed in each of the frame arms, and a reinforcement rib erects at a circumferential edge of the vent window.

4 Claims, 6 Drawing Sheets

-- Prior Art --

SPEAKER FRAME AND SPEAKER DEVICE HAVING A SPEAKER FRAME

CROSS REFERENCE OF RELATED APPLICATION

This application is based on and claims priority under 35 U.S.C. § 119 with respect to Japanese Patent Application No. 2004-353313 filed on Dec. 6, 2004, the entire content of which is incorporated herein by reference.

BACKGROUND OF THE INVENTION

The present invention relates to a speaker frame that supports a vibration system of a speaker and a speaker device having a speaker frame.

Most of speaker devices that are currently in practical use are electromotive speakers. This is because electromotive speakers can not only lower the low-tone reproducible limit frequency because they can produce large amplitudes but also realize considerably high efficiency depending on the design.

Electromotive speaker devices usually have a configuration that a magnetic circuit is fixed to a rear end wall of a speaker frame that supports a vibration system composed of a vibration plate, a voice coil bobbin, etc.

FIG. 1 is a rear view of a speaker frame of a conventional electromotive speaker device.

This speaker frame 101 is produced by integrating, by press-forming a steel plate, a rear end wall 102 to which a magnetic circuit is to be fixed, a damper support portion 104 which is formed at a position that is distant forward from the rear end wall 102 by a prescribed distance, an edge support portion 105 which is provided at a position that is distant forward from the damper support portion 104 by a prescribed distance, and plural frame arms 106 which connect the edge support portion 105 to the rear end wall 102 and the damper support portion 104.

The damper support portion 104 is a portion to which an outer circumferential flange of a damper is stuck and fixed. The damper supports a voice coil bobbin which is connected to the inner periphery of a vibration plate in such a manner that it can advance and retreat along the center axis of the speaker.

The edge support portion 105 is a portion to which an edge is stuck and fixed. The edge is connected to the outer periphery of the vibration plate.

Usually, four or five frame arms 106 are disposed so as to extend radially from the center axis of the speaker. In many cases, the width dimension w of each frame arm 106 is approximately constant from the edge support portion 105 side to the damper support portion 104 side and connecting portions between the outer periphery of the damper support portion 104 and the two side edges of each frame arm 106 assume circular arcs having a relatively small radius R1 (refer to JP-A-2000-244997, for example).

Each opening 107 formed by adjoining frame arms 106 assumes a fan shape because the width dimension w of the frame arms 106 is approximately constant.

SUMMARY OF THE INVENTION

Incidentally, if the rigidity of the speaker frame is low, resonance is caused by undesired waves etc. propagating through the vibration system to lower the acoustic characteristics (e.g., intended sound that is generated by the vibration plate is made impure). Therefore, to prevent such resonance, it is desirable that the speaker frame have as high rigidity (i.e., mechanical strength) as possible. Usually, the rigidity of the speaker frame is evaluated by a load at which the speaker frame is buckled (broken) when a compressive load is applied between its rear end portion and edge support portion along the central axis of the speaker.

In the case of the above-described speaker frame 101, when a compressive load is applied to it, stress tends to be concentrated on the connecting portions (i.e., the small circular arcs having the radius R1) between the damper support portion 104 and the frame arms 106. It is difficult to obtain sufficient compressive strength unless the width dimension w of the frame arms 106 is set very long.

However, if the width dimension w of the frame arms 106 is increased, the area of the openings 107 between the frame arms 106 is decreased accordingly and the degree of passage of sound is thereby lowered on the back side of the vibration plate. This may lower the acoustic characteristics.

There is another problem that the increase in the width dimension w of the frame arms 106 is opposite to the weight reduction of the speaker frame 101.

One measure to increase the compressive strength of the speaker frame without sacrificing weight reduction is to produce it by aluminum die casting rather than press-forming of a steel plate. However, the employment of aluminum die casting is associated with a problem that the cost of the speaker device is increased due to large increases in material cost and manufacturing cost.

An object to be attained by the present invention is, for example, to provide a speaker frame capable of improving the acoustic characteristics while securing high compressive strength without sacrificing weight reduction or cost reduction, as well as a speaker device having such a speaker frame.

To attain the above object, according to a first aspect of the invention, there is provided a speaker frame in which a rear end wall to which a magnetic circuit is to be fixed, a damper support portion which is formed at a position that is distant forward from the rear end wall by a prescribed distance, an edge support portion which is provided at a position that is distant forward from the damper support portion by a prescribed distance and to which an edge as an outer circumferential portion of a vibration plate is to be stuck and fixed, and plural frame arms which connect the edge support portion to the rear end wall and the damper support portion are integrated together, characterized in that a width of each of the frame arms increases gradually as the position goes from the edge support portion to the damper support portion, and damper-support-portion-side end portions of side edges, opposed to each other, of adjoining frame arms are continuous with each other to form a single, smooth curve having, as an axis of symmetry, a bisector of an angle formed by the adjoining frame arms; and that a single vent window is formed on each of the frame arms at the center in its width direction, and a reinforcement rib erects at a circumferential edge of the vent window.

Further, according to a second aspect of the invention, a speaker device includes the speaker frame according to the first aspect of the invention.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

A speaker frame and a speaker device having a speaker frame according to an embodiment of the present invention will be hereinafter described in detail with reference to the accompanying drawings.

Figure 2:
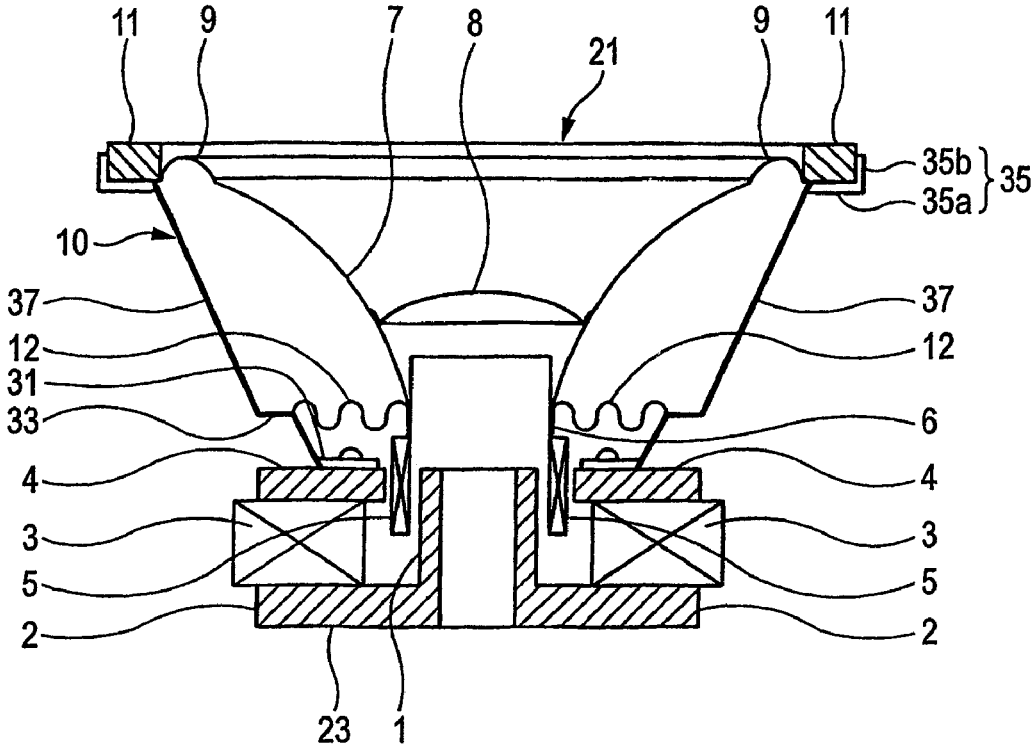
FIG. 2 is a vertical sectional view of a speaker device having a speaker frame according to an embodiment of the present invention.
Figure 3:
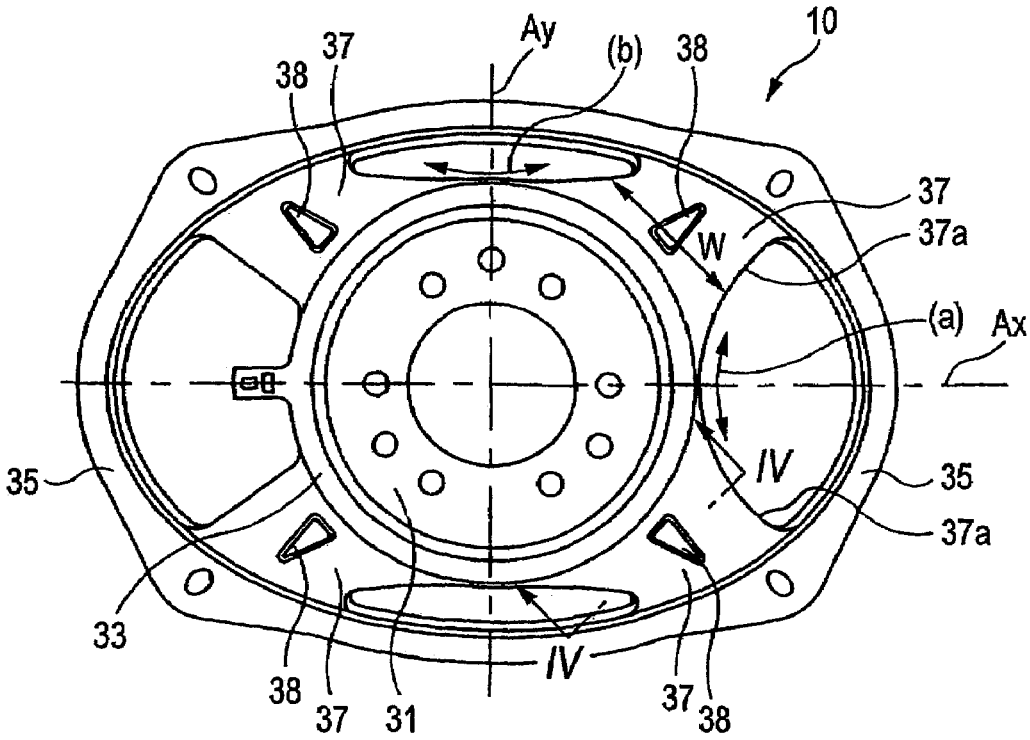
FIG. 3 is a rear view of the speaker frame according to the embodiment shown in FIG. 2.
Figure 4:
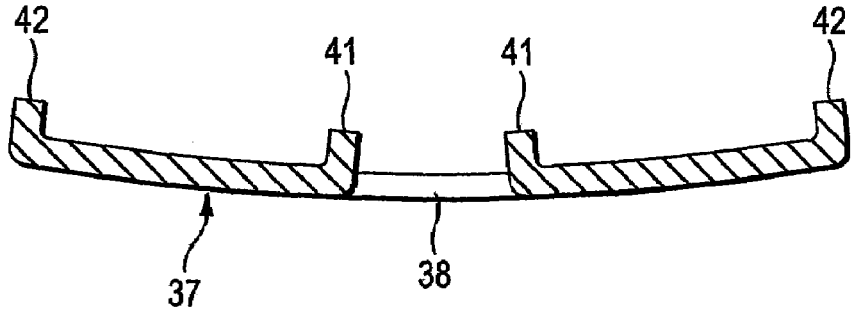
FIG. 4 is a sectional view taken along line IV-IV in FIG. 3.

FIG. 2 is a vertical sectional view of a speaker device having a speaker frame according to the embodiment of the invention. FIG. 3 is a rear view of the speaker frame according to the embodiment shown in FIG. 2. FIG. 4 is a sectional view taken along line IV-IV in FIG. 3.

The speaker device 21 shown in FIG. 2 is an electromotive speaker device employing a vibration plate 7 whose outer periphery assumes an elliptical shape. A ring-shape magnet 3 is fixed to the top of a yoke 2 having a center pole 1. A ring-shaped plate 4 is fixed to the top of the magnet 3. The center pole 1, the yoke 2, the magnet 3, and the plate 4 constitute a magnetic circuit 23 for driving the vibration plate 7.

A coil bobbin 6 on which a voice coil 5 is wound is disposed in a gap that is formed by the plate 4 and the center pole 1 which are part of the magnetic circuit 23.

The inner periphery of the vibration plate 7 is fixed to the coil bobbin 6. A center cap (dust cap) 8 is stuck to the vibration plate 7 so as to cover the inside opening of the vibration plate 7. The outer periphery of the vibration plate 7 is supported, via an edge 9, by an edge support portion 35 which is a front portion of a speaker frame 10 which is attached to the plate 4.

In FIG. 2, reference numerals 11 and 12 denote a ring-shaped packing and a corrugation damper, respectively.

As shown in FIG. 3, the speaker frame 10 according to the embodiment is produced by integrating, by press-forming a steel plate, a rear end wall 31 to which the magnetic circuit 23 is to be fixed, a damper support portion 33 which is formed at a position that is distant forward from the rear end wall 31 by a prescribed distance, the edge support portion 35 which is provided at a position that is distant forward from the damper support portion 33 by a prescribed distance, and four frame arms 37 which connect the edge support portion 35 to the rear end wall 31 and the damper support portion 33. An outer circumferential flange of the edge 9 as an outer circumferential portion of the vibration plate 7 is to be stuck and fixed to the edge support portion 35.

The damper support portion 33 is an annular flat portion to which an outer circumferential flange of the corrugation damper 12 is stuck.

The edge support portion 35 is provided with an annular flat portion 35*a* to which the outer circumferential flange of the edge 9 is stuck and a packing pressing wall 35*b* which is formed by bending an outer circumferential portion of the flat portion 35*a*. The packing pressing wall 35*b* also functions as a reinforcement rib for increasing the strength of the edge support portion 35.

In this embodiment, the width dimension w of each frame arm 37 gradually increases from the edge support portion 35 side to the damper support portion 33 side. And damper-support-portion-33-side end portions of side edges 37*a*, opposed to each other, of adjoining frame arms 37 are continuous with each other to form a single, smooth curve having, as an axis of symmetry, a bisector Ax or Ay of the angle formed by the adjoining frame arms 37.

A single vent window 38 is formed on each frame arm 37 at the center in its width direction. As shown in FIG. 4, reinforcement ribs 41 and 42 erect at the circumferential edge of the vent window 38 and the side edges of each frame arm 37.

The reinforcement ribs 41 and 42 are formed so as to be integral with the frame arm 37 by drawing or by cutting and erecting by press forming.

In the above-described speaker frame 10, as indicated by arrows (a) and (b) in FIG. 3, connecting portions between the outer periphery of the damper support portion 33 and the side edges of the frame arms 37 assume curves having a large radius of curvature. Therefore, stress is not concentrated on those connecting portions when a compressive load is applied to the speaker frame 10. The avoidance of the stress concentration is a first factor in increasing the compressive strength.

Since the width dimension w of each frame arm 37 gradually increases from the edge support portion 35 side to the damper support portion 33 side (i.e., each frame arm 37 is tapered), the average width dimension of each frame arm 37 is increased and the increase in the cross section of the frame arms 37 also serves to increase the compressive strength.

Since the vent windows 38 are formed in the respective frame arms 37, the degree of rearward passage of sound is not lowered through the frame arms 37 are wide.

The reinforcement ribs 41 which are provided at the circumferential edges of the vent windows 38 serve to increase the strength of the frame arms 37.

That is, in the speaker frame 10 according to the embodiment, the avoidance of stress concentration on the connecting portions between the damper support portion 33 and the frame arms 37, the increase in compressive strength attained by the increase in the width dimension w of each frame arm 37, the increase in the strength of each frame arm 37 attained by the reinforcement ribs 41 formed at the circumferential edges of the vent window 38 of the frame arm 37, and other factors together increase the compressive strength of the speaker frame 10 greatly. As a result, the speaker frame 10 can be prevented from resonating due to propagation of undesired waves (vibration) and the acoustic characteristics can thereby be improved.

The vent windows 38 formed in the respective frame arms 37 increase the degree of rearward passage of sound coming from the vibration plate 7, which also improves the acoustic characteristics.

The vent windows 38 formed in the respective frame arms 37 also function as lightening holes for preventing weight increase, and hence the weight reduction is not sacrificed.

In the speaker frame 10 according to the embodiment, the number of frame arms 37 is a relatively small number of four and hence the structure of the frame arms 37 is not unduly complex. The simplified structure of the frame arms 37 enables cost reduction.

Further, the manufacturing method of the speaker frame 10 according to the embodiment is press forming, which is suitable for cost reduction due to mass production. This enables cost reduction of the speaker device 21.

Furthermore, press-forming the reinforcement ribs 41 and 42 at the circumferential edge of the vent window 38 and at the side edges of each frame arm 37 in such a manner that they are integral with the frame arm 37 makes it easier to obtain a speaker frame 10 that is light and has high compressive strength.

Figure 1:
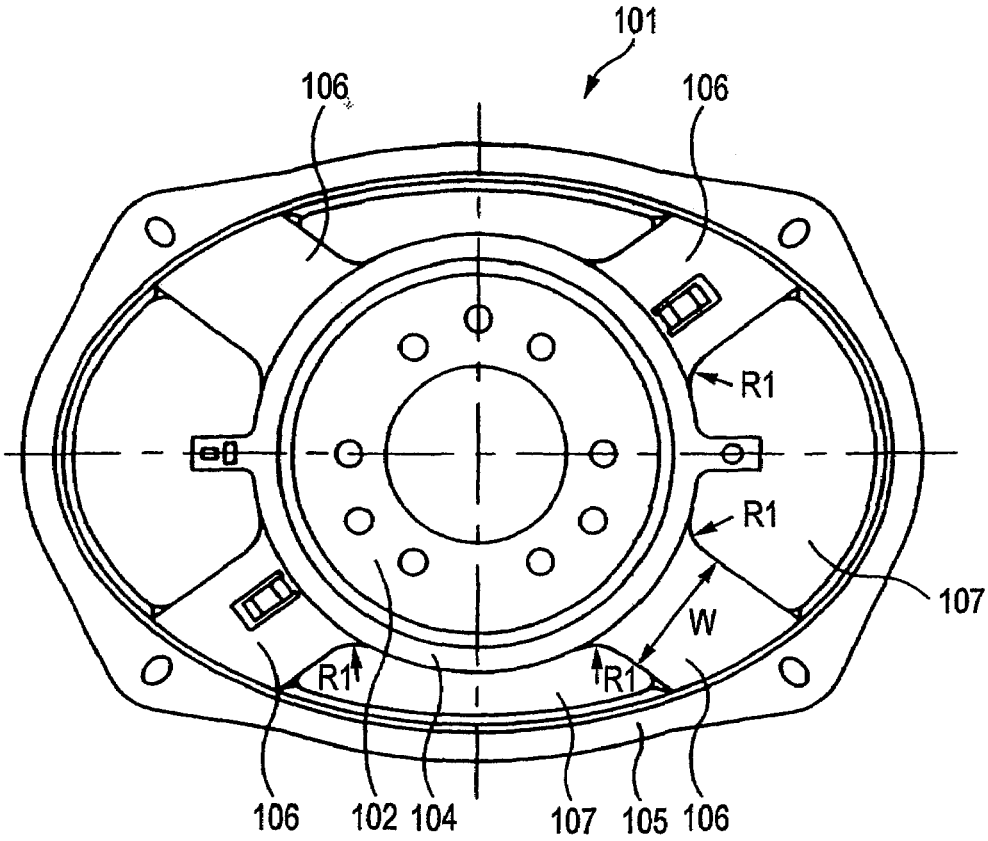
FIG. 1 is a rear view of a conventional speaker frame.

To confirm the workings and the advantages of the embodiment, compressive strength measurement tests were performed on speaker frames 10 according to the embodiment having the configuration of FIG. 3 and conventional speaker frames 101 having the configuration of FIG. 1 and results were compared with each other.

Figure 5A:
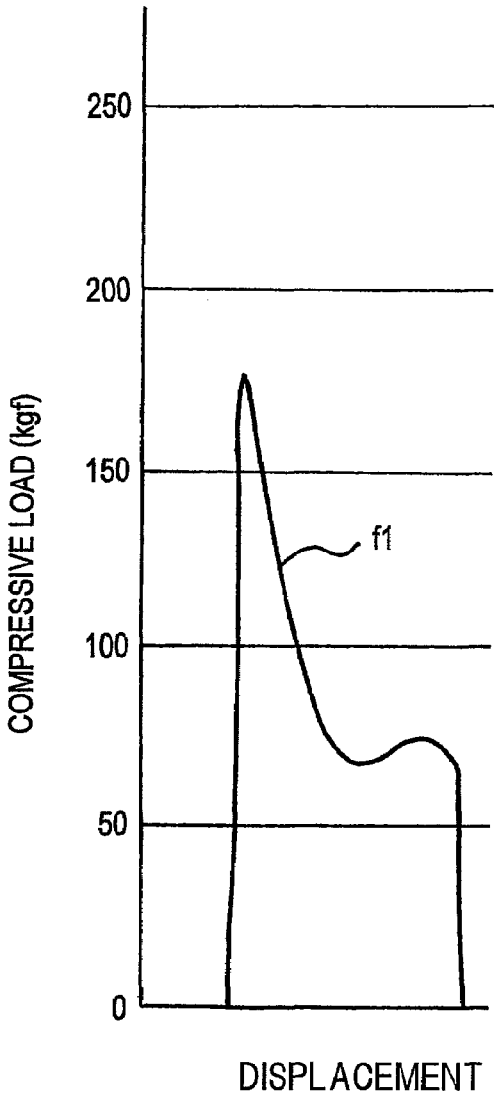
FIGS. 5A and 5B are graphs comparing compressive strength of a speaker frame of Example 1 according to the embodiment of the invention with that of a conventional speaker frame.
Figure 5B:
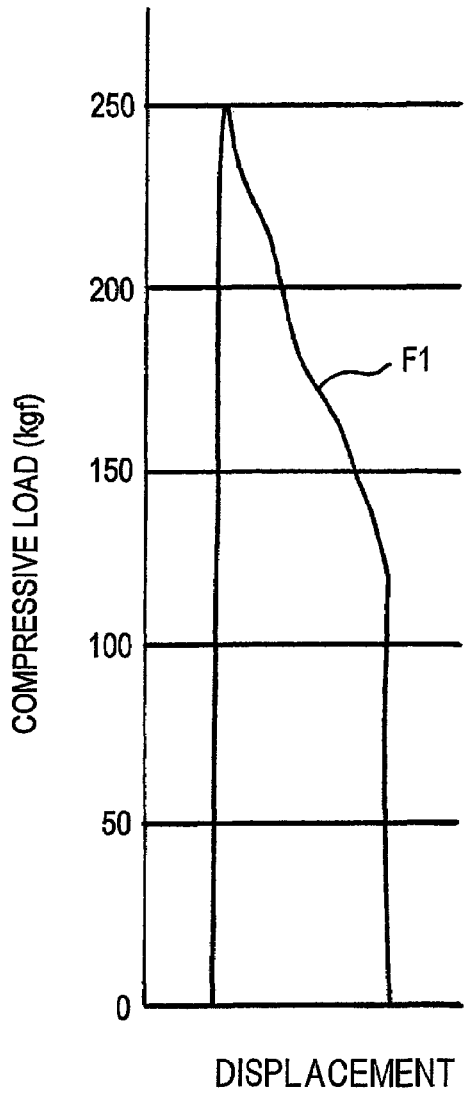

A characteristic curve f1 in FIG. 5A represents compressive strength of a speaker frame 101 having the conventional configuration in which the aperture is elliptical and measures 6 inch×9 inch (diameters) and the axial length from the edge support portion to the damper support portion is great (deep type). A characteristic curve F1 in FIG. 5B represents compressive strength of a speaker frame 10 of Example 1 according to the invention that has the configuration of FIG. 3 though the aperture diameters and the depth are the same as the above speaker frame 101.

Whereas the conventional speaker frame 101 exhibited compressive strength of about 175 kgf, the speaker frame 10 of Example 1 according to the invention exhibited compressive strength of about 250 kgf, which means an about 43% increase in strength.

Figure 6A:
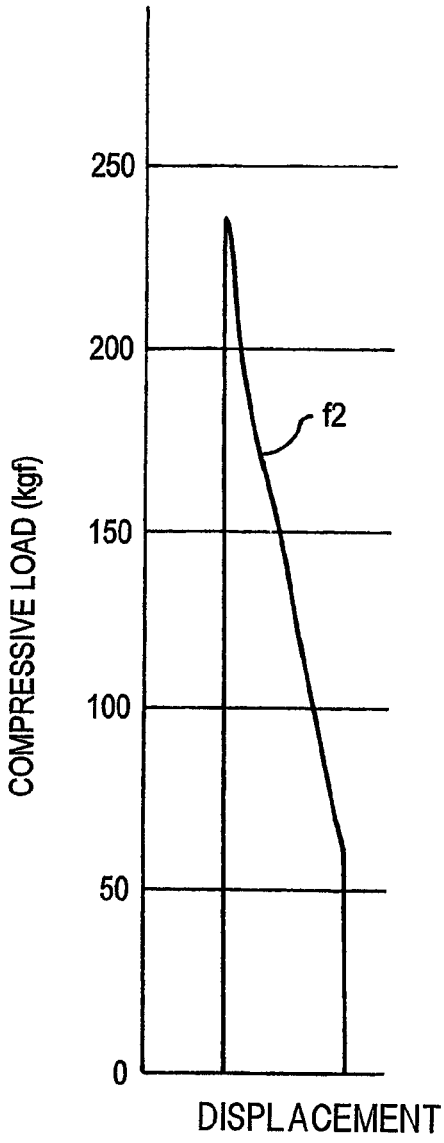
FIGS. 6A and 6B are graphs comparing compressive strength of a speaker frame of Example 2 according to the embodiment of the invention with that of a conventional speaker frame.
Figure 6B:
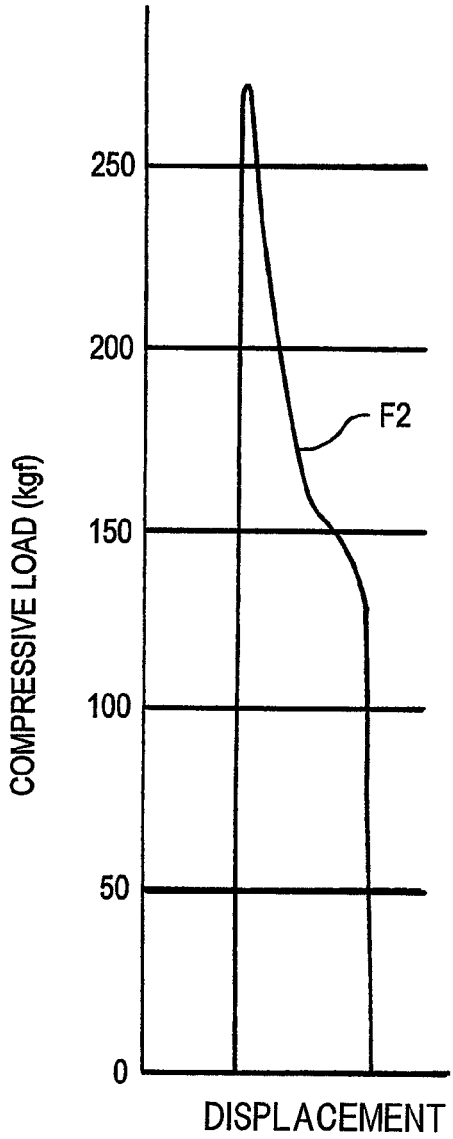

A characteristic curve f2 in FIG. 6A represents compressive strength of a speaker frame 101 having the conventional configuration in which the aperture is circular and has a diameter of 16 cm and the axial length from the edge support portion to the damper support portion is great (deep type). A characteristic curve F2 in FIG. 6B represents compressive strength of a speaker frame 10 of Example 2 according to the invention that has the configuration of FIG. 3 though the aperture diameters and the depth are the same as the above speaker frame 101.

Whereas the conventional speaker frame 101 exhibited compressive strength of about 236 kgf, the speaker frame 10 of Example 2 according to the invention exhibited compressive strength of about 271 kgf, which means an about 15% increase in strength.

Figure 7A:
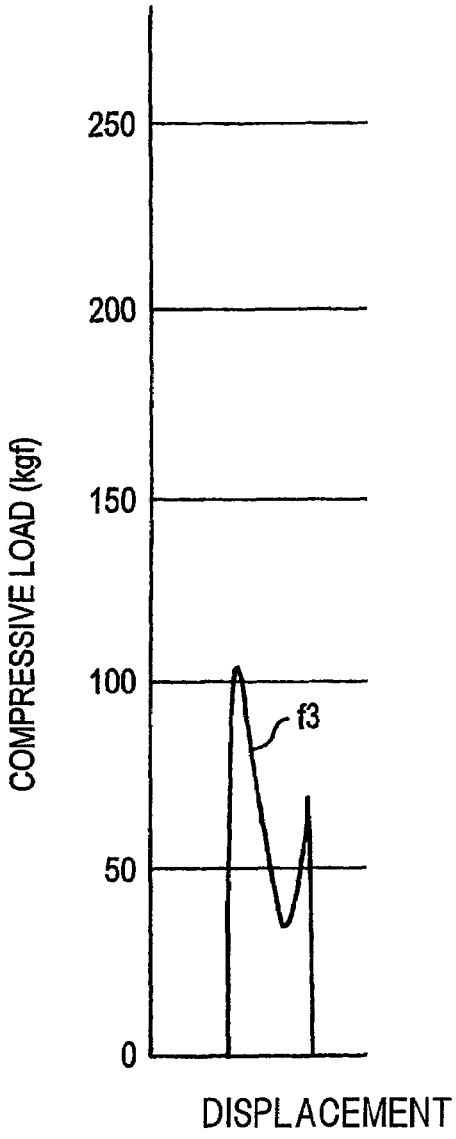
FIGS. 7A and 7B are graphs comparing compressive strength of a speaker frame of Example 3 according to the embodiment of the invention with that of a conventional speaker frame.
Figure 7B:
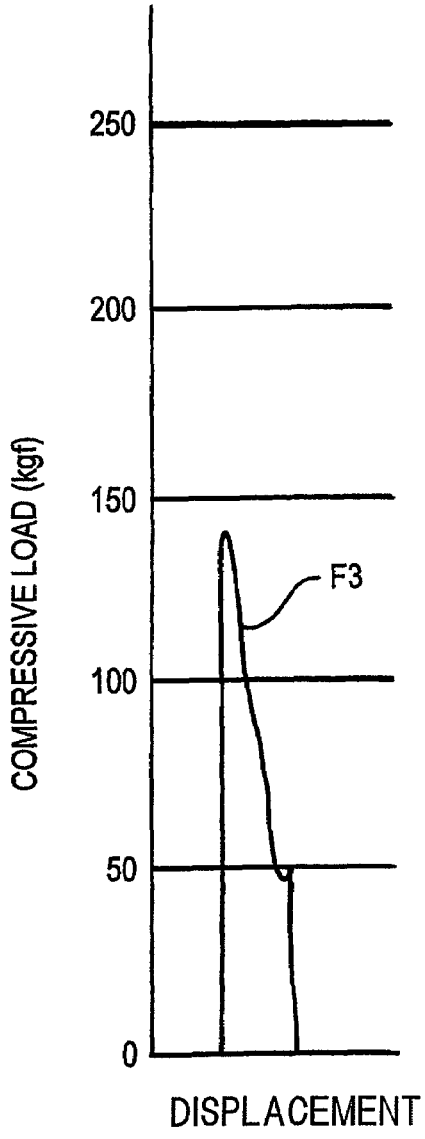

A characteristic curve f3 in FIG. 7A represents compressive strength of a speaker frame 101 having the conventional configuration in which the aperture is circular and has a diameter of 16 cm and the axial length from the edge support portion to the damper support portion is short (shallow type). A characteristic curve F3 in FIG. 7B represents compressive strength of a speaker frame 10 of Example 3 according to the invention that has the configuration of FIG. 3 though the aperture diameters and the depth are the same as the above speaker frame 101.

Whereas the conventional speaker frame 101 exhibited compressive strength of about 103 kgf, the speaker frame 10 of Example 2 according to the invention exhibited compressive strength of about 140 kgf, which means an about 36% increase in strength.

As shown in FIGS. 5A to 7B, the compressive strength increasing effect of the configuration according to the invention was confirmed in each of the cases that the vibration plate was elliptical and circular, respectively, as well as in each of the cases that the inclination of the vibration plate was steep (deep type) and gentle (shallow type), respectively.

Although in the above embodiment the number of frame arms is four, it may be increased or decreased to any other number.

As described above in detail, the speaker frame according to the embodiment of the invention is the speaker frame 10 in which the rear end wall 31 to which the magnetic circuit 23 is to be fixed, the damper support portion 33 which is formed at a position that is distant forward from the rear end wall 31 by a prescribed distance, the edge support portion 35 which is provided at a position that is distant forward from the damper support portion 33 by a prescribed distance and to which the edge 9 as the outer circumferential portion of the vibration plate is to be stuck and fixed, and the plural frame arms 37 which connect the edge support portion 35 to the rear end wall 31 and the damper support portion 33 are integrated together. The width of each of the frame arms 37 increases gradually as the position goes from the edge support portion 35 to the damper support portion 33, and damper-support-portion-33-side end portions of the side edges 37*a*, opposed to each other, of adjoining frame arms 37 are continuous with each other to form a single, smooth curve having, as an axis of symmetry, the bisector of the angle formed by the adjoining frame arms 37. The single vent window 38 is formed on each of the frame arms 37 at the center in its width direction, and the reinforcement rib 41 erects at the circumferential edge of the vent window 38.

This configuration makes it possible to improve the acoustic characteristics of a speaker device while securing high compressive strength without sacrificing weight reduction or cost reduction.

What is claimed is:

1. A speaker frame comprising:

a rear end wall to which a magnetic circuit is to be fixed;

a damper support portion which is formed at a position that is distant forward from the rear end wall by a prescribed distance;

an edge support portion which is provided at a position that is distant forward from the damper support portion by a prescribed distance and to which an edge as an outer circumferential portion of a vibration plate is to be stuck and fixed; and plural frame arms which connect the edge support portion to the rear end wall and the damper support portion, wherein:

a width of each of the frame arms increases gradually as the position goes from the edge support portion to the damper support portion, and damper-support-portion-side end portions of side edges, opposed to each other, of adjoining frame arms are continuous with each other to form a single, smooth curve having, as an axis of symmetry, a bisector of an angle formed by the adjoining frame arms; and a single vent window is formed on each of the frame arms at the center in its width direction, and a reinforcement rib erects at a circumferential edge of the vent window.

2. The speaker device according to claim 1, wherein the number of frame arms is four.

3. The speaker device according to claim 1, wherein the rear end wall, the edge support portion, and the frame arms are formed so as to be integral with each other by press-forming a steel plate, and the reinforcement rib is formed so as to be integral with the associated one of the frame arms by drawing or by cutting and erecting by press forming.

4. A speaker device comprising:

a magnetic circuit;

a vibration plate; and a speaker frame including:

a rear end wall to which the magnetic circuit is to be fixed;

a damper support portion which is formed at a position that is distant forward from the rear end wall by a prescribed distance;

an edge support portion which is provided at a position that is distant forward from the damper support portion by a prescribed distance and to which an edge as an outer circumferential portion of the vibration plate is to be stuck and fixed; and plural frame arms which connect the edge support portion to the rear end wall and the damper support portion, wherein:

a width of each of the frame arms increases gradually as the position goes from the edge support portion to the damper support portion, and damper-support-portion-side end portions of side edges, opposed to each other, of adjoining frame arms are continuous with each other to form a single, smooth curve having, as an axis of symmetry, a bisector of an angle formed by the adjoining frame arms; and a single vent window is formed on each of the frame arms at the center in its width direction, and a reinforcement rib erects at a circumferential edge of the vent window.

* * * * *